US009573668B2

(12) United States Patent
Dreher

(10) Patent No.: US 9,573,668 B2
(45) Date of Patent: Feb. 21, 2017

(54) SLEEVE AND COLLAR SYSTEM FOR AN OAR AND METHOD OF MAKING SAME

(71) Applicant: Durham Boat Company, Inc., Durham, NH (US)

(72) Inventor: Michael Dreher, Durham, NH (US)

(73) Assignee: Durham Boat Company, Inc., Durham, NH (US)

( * ) Notice: Subject to any disclaimer, the term of this patent is extended or adjusted under 35 U.S.C. 154(b) by 0 days.

(21) Appl. No.: 14/942,430

(22) Filed: Nov. 16, 2015

(65) Prior Publication Data

US 2016/0152311 A1 Jun. 2, 2016

Related U.S. Application Data

(60) Provisional application No. 62/085,905, filed on Dec. 1, 2014.

(51) Int. Cl.
*B63H 16/04* (2006.01)

(52) U.S. Cl.
CPC ..... *B63H 16/04* (2013.01); *B63H 2016/043* (2013.01)

(58) Field of Classification Search
CPC ..... B63H 16/04; B63H 2016/043
USPC ..... 440/101
See application file for complete search history.

(56) References Cited

U.S. PATENT DOCUMENTS

| | | | | |
|---|---|---|---|---|
| 1,450,475 | A | 4/1923 | Wintemute | |
| 4,662,849 | A | 5/1987 | Loerch | |
| 5,324,218 | A | 6/1994 | Rijnders | |
| 8,002,598 | B2 | 8/2011 | Ninham et al. | |
| 9,394,044 | B1 * | 7/2016 | Horan | B63H 16/073 |
| 2001/0029135 | A1 | 10/2001 | Zolnay | |
| 2011/0189910 | A1 | 8/2011 | Sakellarides | |

FOREIGN PATENT DOCUMENTS

| | | | |
|---|---|---|---|
| FR | 2771374 | B1 | 2/2000 |
| GB | 471718 | A | 9/1937 |

* cited by examiner

*Primary Examiner* — Lars A Olson
(74) *Attorney, Agent, or Firm* — Armstrong Teasdale LLP

(57) ABSTRACT

A sleeve and collar system for an oar includes a sleeve configured to couple to a shaft portion of the oar. The sleeve includes an outer surface. The system also includes a wear collar configured to couple around the sleeve at each of a plurality of longitudinal positions along the sleeve. The wear collar is configured to bear substantially all direct contact from an oarlock during a rowing stroke of the oar. A radially inner surface of the wear collar is shaped to be complementary to at least a portion of the sleeve outer surface, such that the wear collar inner surface and the sleeve outer surface cooperate to maintain the wear collar in a predetermined orientation about a longitudinal axis of the sleeve at each of the plurality of longitudinal positions.

17 Claims, 5 Drawing Sheets

SLEEVE AND COLLAR SYSTEM FOR AN OAR AND METHOD OF MAKING SAME

CROSS REFERENCE TO RELATED APPLICATIONS

This application claims the benefit of U.S. Provisional Application Ser. No. 62/085,905, filed on Dec. 1, 2014, entitled "SLEEVE AND COLLAR SYSTEM FOR AN OAR," the disclosure of which is incorporated herein by reference in its entirety.

BACKGROUND

The field of the disclosure relates generally to rowing equipment, and more particularly to a sleeve and collar for a rowing oar.

At least some known boats include oars used by a rower to provide forward thrust to move the boat. For example, the oar acts as a lever that pivots around a fulcrum fixed to the boat as the rower moves the oar back and forth through a rowing motion. As least some known oars use an oarlock as the fulcrum. For example, the oar is inserted through the oarlock, and the oarlock pivots on a vertical pin coupled to the boat. At least some known oars include sleeves that are fixed to the oar to improve handling of the oar and/or to act as a replaceable wear surface for the oar at an oarlock contact area. At least some known sleeves are used with a collar that couples around a portion of the sleeve and acts as a stop to prevent the oar from sliding completely through the oarlock.

At least some known collars can be selectively coupled to any of several locations on the sleeve, such that each location provides a correspondingly different mechanical gearing for the rowing motion. At least some rowers prefer to select a different mechanical gearing, and hence a different collar position, for different performance conditions. However, at least some known sleeves, such as but not limited to some two-piece molded thermoplastic sleeves installed on the oar with a bonding agent, tend to twist and/or bulge during installation. The twisting and/or bulging causes an oar blade pitch angle, determined by the interface between the oarlock and the sleeve at the oarlock contact area, to vary for different collar positions, adversely affecting the rower's performance.

Moreover, at least some known sleeves require a user to apply a tool, such as a screwdriver, to reposition the collar. The required use of the tool increases a complexity of changing the mechanical gearing, both on land and in the boat. At least some known sleeves at least partially address this concern by providing spacers that can be positioned on an outboard side of the collar. However, because the spacers move the oarlock contact area to a different position on the sleeve, the problem of varying blade pitch angle is not resolved.

BRIEF DESCRIPTION

In one aspect, a sleeve and collar system for an oar is provided. The system includes a sleeve configured to couple to a shaft portion of the oar. The sleeve includes an outer surface. The system also includes a wear collar configured to couple around the sleeve at each of a plurality of longitudinal positions along the sleeve. The wear collar is configured to bear substantially all direct contact from an oarlock during a rowing stroke of the oar. A radially inner surface of the wear collar is shaped to be complementary to at least a portion of the sleeve outer surface, such that the wear collar inner surface and the sleeve outer surface cooperate to maintain the wear collar in a predetermined orientation about a longitudinal axis of the sleeve at each of the plurality of longitudinal positions.

In another aspect, an oar is provided. The oar includes a shaft portion and a sleeve configured to couple to the shaft portion. The sleeve includes an outer surface. The oar also includes a wear collar configured to couple around the sleeve at each of a plurality of longitudinal positions along the sleeve. The wear collar is configured to bear substantially all direct contact from an oarlock during a rowing stroke of the oar. A radially inner surface of the wear collar is shaped to be complementary to at least a portion of the sleeve outer surface, such that the wear collar inner surface and the sleeve outer surface cooperate to maintain the wear collar in a predetermined orientation about a longitudinal axis of the sleeve at each of the plurality of longitudinal positions.

In another aspect, a method of forming a sleeve and collar system for an oar is provided. The method includes configuring a wear collar to couple around a sleeve at each of a plurality of longitudinal positions along the sleeve. The sleeve is configured to couple to a shaft portion of the oar and includes an outer surface. The wear collar is configured to bear substantially all direct contact from an oarlock during a rowing stroke of the oar. The method also includes shaping a radially inner surface of the wear collar to be complementary to at least a portion of the sleeve outer surface, such that the wear collar inner surface and the sleeve outer surface cooperate to maintain the wear collar in a predetermined orientation about a longitudinal axis of the sleeve at each of the plurality of longitudinal positions.

DETAILED DESCRIPTION

The exemplary systems and methods described herein overcome at least some of the disadvantages associated with known sleeves and collars for oars. The embodiments described herein include a wear collar coupled around a sleeve and selectively positionable longitudinally along the sleeve. For each selected position of the wear collar along the sleeve, an interface between the oar and an oarlock of a boat during a rowing stroke is located substantially exclusively at the wear collar. The wear collar is shaped to facilitate maintaining a constant blade pitch angle at each selected position. In some embodiments, the wear collar is repositionable along the sleeve without the use of additional tools.

Figure 1:
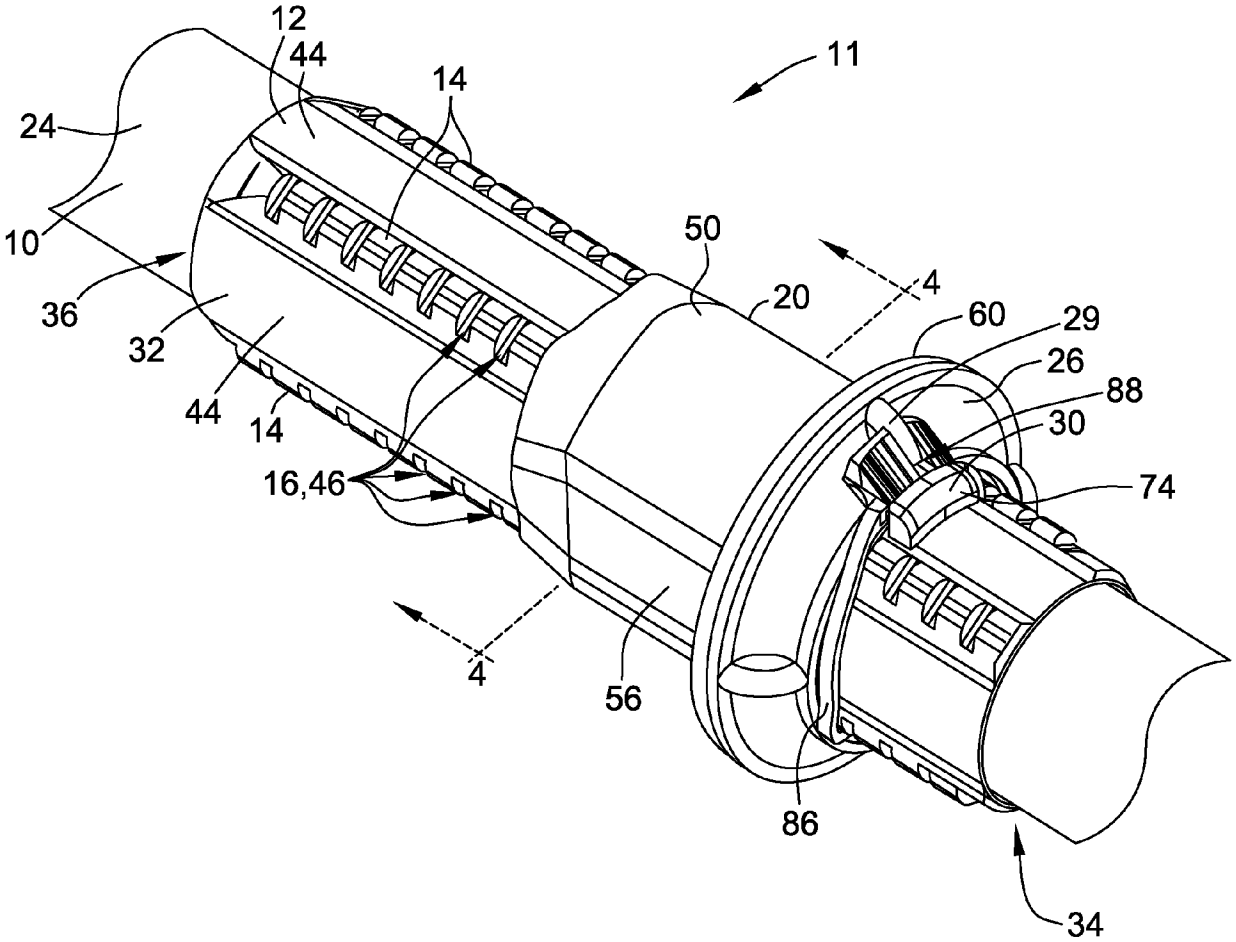
FIG. 1 is a schematic perspective view of an exemplary embodiment of a sleeve and collar system coupled to a shaft portion of an exemplary oar.
Figure 2:
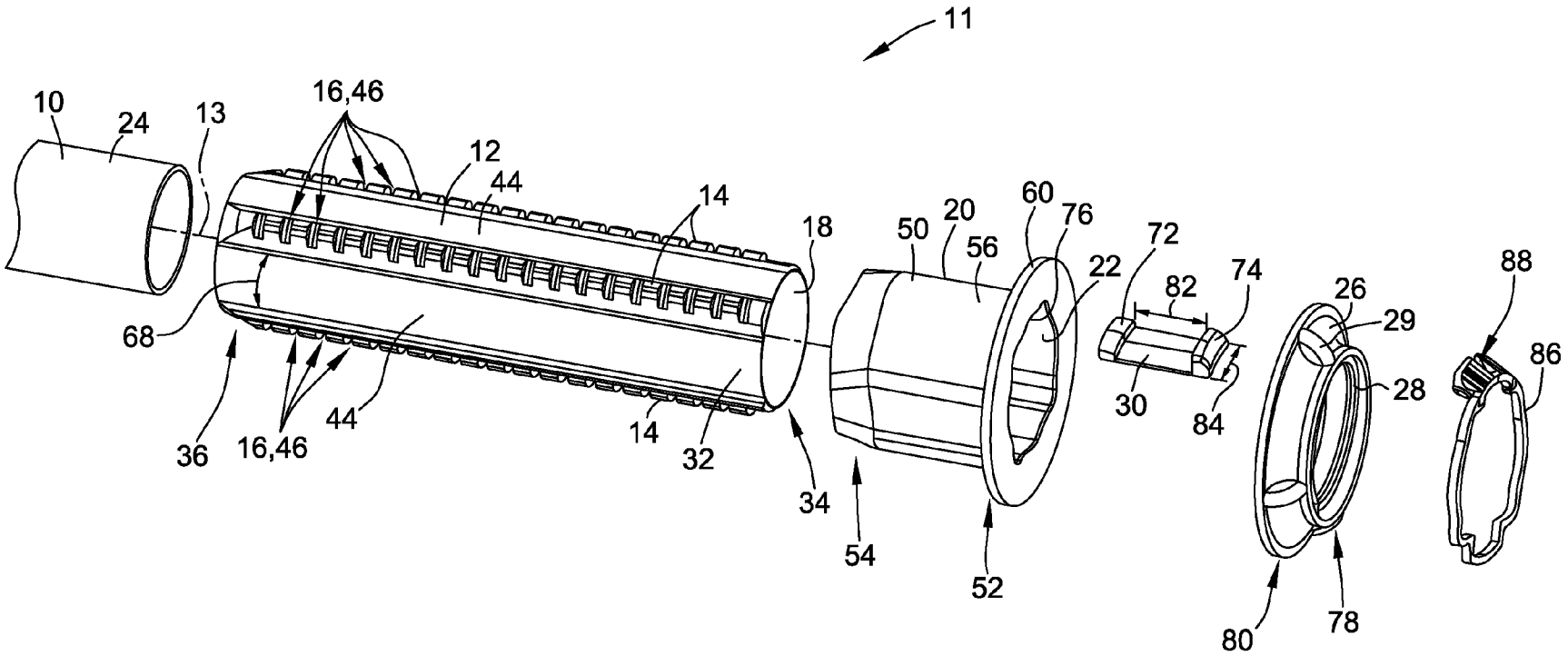
FIG. 2 is a schematic exploded perspective view of the exemplary sleeve and collar system of FIG. 1.
Figure 3:
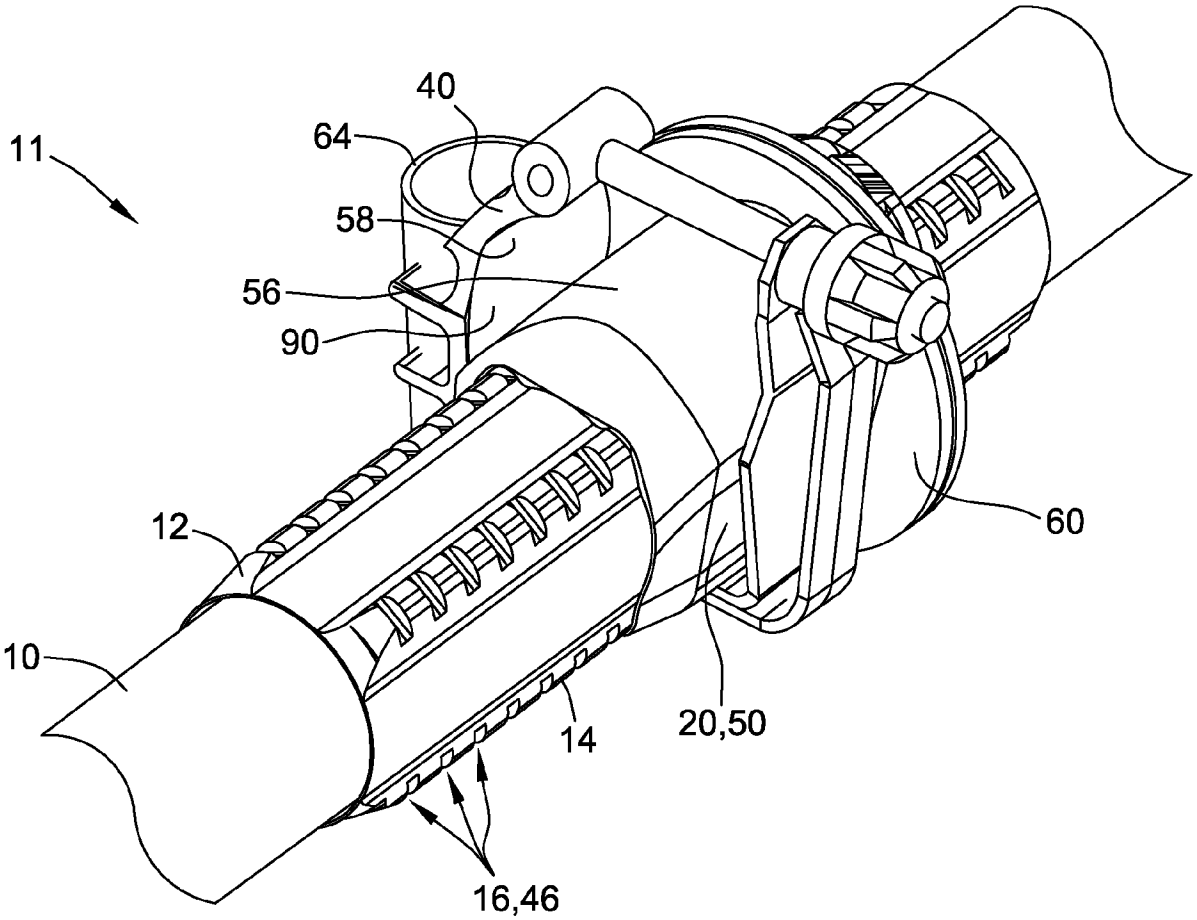
FIG. 3 is a schematic perspective view of the exemplary oar shaft portion of FIG. 1 coupled to the exemplary sleeve and collar system of FIG. 1 and inserted through an exemplary oarlock.
Figure 4:
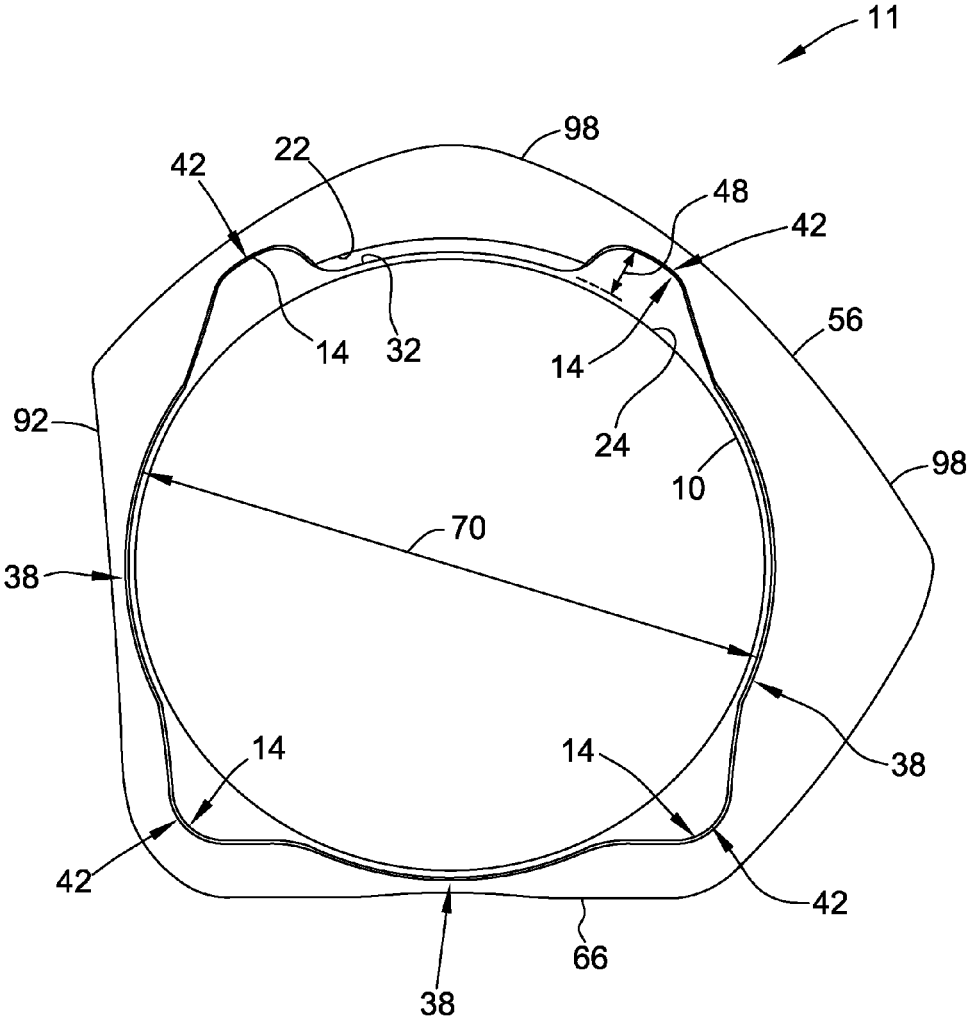
FIG. 4 is a schematic sectional view of an exemplary embodiment of a wear collar included in the exemplary sleeve and collar system of FIG. 1, taken along line 4-4 shown in FIG. 2.
Figure 5:
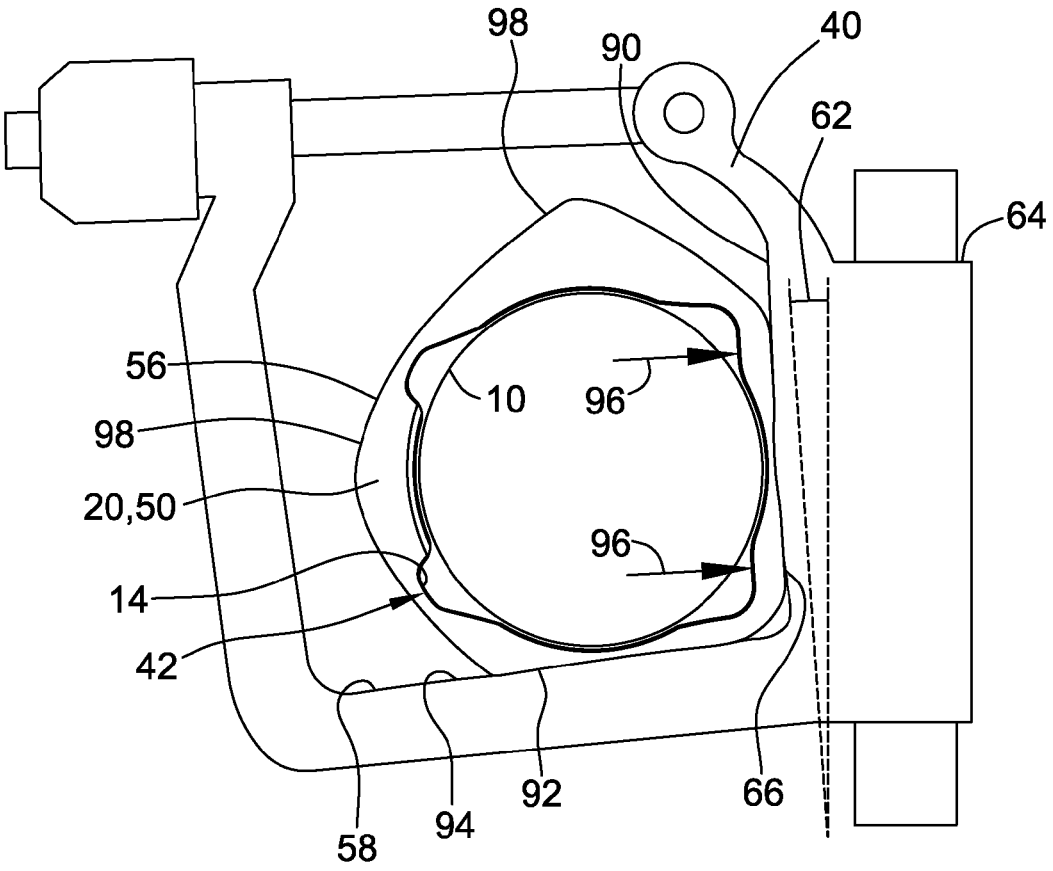
FIG. 5 is a schematic sectional view of the exemplary sleeve and collar system of FIG. 1 inserted through the exemplary oarlock of FIG. 3.

FIG. 1 is a schematic perspective view of an exemplary embodiment of a sleeve and collar system 11 coupled to a shaft portion of an exemplary oar 10. FIG. 2 is a schematic exploded perspective view of sleeve and collar system 11. FIG. 3 is a schematic perspective view of the shaft portion of oar 10 coupled to sleeve and collar system 11 and inserted through an exemplary oarlock 40. FIG. 4 is a schematic sectional view of sleeve and collar system 11 taken along line 4-4 shown in FIG. 1. FIG. 5 is a schematic sectional view of sleeve and collar system 11 inserted through oarlock 40.

Referring to FIGS. 1-5, sleeve and collar system 11 includes a sleeve 12 and a wear collar 20. Wear collar 20 is configured to couple around sleeve 12 at each of a plurality of longitudinal positions along sleeve 12. Sleeve 12 extends longitudinally in a generally tubular shape from a first end 34 to a second end 36. In some embodiments, sleeve 12 is formed integrally. In alternative embodiments, sleeve 12 is formed from separately formed components in any suitable fashion that enables sleeve 12 to function as described herein.

In the exemplary embodiment, a radially inner surface 18 of sleeve 12 is configured to couple against an outer surface 24 of oar 10. In certain embodiments, inner surface 18 of sleeve 12 is secured to outer surface 24 of oar 10 using a suitable adhesive. In alternative embodiments, inner surface 18 of sleeve 12 is secured to outer surface 24 of oar 10 in any suitable fashion that enables sleeve 12 to function as described herein. In other alternative embodiments, sleeve 12 is formed integrally with the shaft portion of oar 10.

Because wear collar 20 bears substantially all of the direct contact from oarlock 40 during the rowing stroke, as will be described herein, sleeve 12 can be formed and coupled to oar 10 in a fashion that enables increased consistency in a radially outer surface 32 of sleeve 12 at different longitudinal positions along sleeve 12, as compared to a sleeve (not shown) that is formed to bear substantial direct contact with oarlock 40. Thus, in certain embodiments, sleeve 12 is formed in any suitable fashion that provides consistency in radially outer surface 32 of sleeve 12 at different longitudinal positions along sleeve 12. For example, but not by way of limitation, portions of sleeve 12 are relatively thin as compared to a sleeve (not shown) that is formed to bear substantial direct contact with oarlock 40. Thus, sleeve 12 is less susceptible to twisting and/or bulging of outer surface 32.

In the exemplary embodiment, outer surface 32 of sleeve 12 includes a plurality of alignment surfaces 14. In the exemplary embodiment, each alignment surface 14 extends longitudinally from first end 34 to second end 36. In alternative embodiments, at least one alignment surface 14 extends longitudinally only partially between first end 34 and second end 36. As can be seen particularly in FIG. 4, alignment surfaces 14 define a radially outermost portion of outer surface 32 of sleeve 12. Each circumferentially adjacent pair of alignment surfaces 14 is separated by one of plurality of contoured portions 44, such that contoured portions 44 and alignment surfaces 14 alternate circumferentially along outer surface 32.

In certain embodiments, outer surface 32 along each contoured portion 44 generally follows a contour of outer surface 24 of oar 10. For example, in the exemplary embodiment, outer surface 24 defines an approximately circular cross-section, and outer surface 32 along each contoured portion 44 defines a portion of a correspondingly circular cross-section. A circumferential length 68 of each contoured portion 44 is defined between adjacent alignment surfaces 14. In the exemplary embodiment, circumferential length 68 of at least one of contoured portions 44 differs from circumferential length 68 for another of contoured portions 44, to facilitate orienting wear collar 20 properly around sleeve 12.

In the exemplary embodiment, each contoured portion 44 is relatively thin, as described above, and presents a relatively smooth surface. In alternative embodiments, at least one inset portion 44 is other than relatively thin and/or substantially smooth.

In the exemplary embodiment, each alignment surface 14 includes a plurality of grooves 16 defined therein. Grooves 16 disposed on alignment surfaces 14 cooperate to define a helical thread 46 on outer surface 32 of sleeve 12. For example, grooves 16 of plurality of alignment surfaces 14 are suitably spaced relative to each other, and substantially equally inclined relative to a plane normal to shaft portion of oar 10, such that they cooperate to define helical thread 46. In certain embodiments, alignment surfaces 14 are circumferentially spaced apart such that helical thread 46 is discontinuous. The discontinuity of helical thread 46 enables contoured portions 44 to be disposed at least partially co-extensively with helical thread 46 along outer surface 32.

In the exemplary embodiment, the plurality of contoured portions 44 includes four contoured portions 44, and the plurality of alignment surfaces 14 includes four alignment surfaces 14. In alternative embodiments, outer surface 32 includes any suitable number of contoured portions 44 and any suitable number of alignment surfaces 14 that enables sleeve 12 to function as described herein.

Wear collar 20 includes a generally tubular wear portion 50 that extends longitudinally from a first end 52 to a second end 54, and a generally annular-disk shaped collar portion 60 extending radially outwardly proximate wear portion first end 52. In the exemplary embodiment, wear portion 50 and collar portion 60 are formed integrally. In alternative embodiments, wear portion 50 and collar portion 60 are formed separately and coupled together in any suitable fashion that enables wear collar 20 to function as described herein.

A radially inner surface 22 of wear portion 50 is shaped to be complementary to at least a portion of outer surface 32 of sleeve 12. Moreover, the complementary relationship of wear portion inner surface 50 and sleeve outer surface 32 is configured to maintain wear collar 20 in a predetermined rotational orientation about a longitudinal axis 13 of sleeve 12 when wear collar 20 is positioned at each of the plurality of longitudinal positions along sleeve 12.

In the exemplary embodiment, inner surface 22 defines a plurality of grooved portions 42 that are complementary to plurality of alignment surfaces 14. For example, a cross-sectional shape of each grooved portion 42 is complementary to a cross-sectional shape of a corresponding alignment surface 14. For another example, each alignment surface 14 extends radially outward beyond an adjacent contoured portion 44 by a thickness 48, and each grooved portion 42 is configured to receive thickness 48 in a clearance fit. Thus, in the exemplary embodiment, the complementary relationship of alignment surfaces 14 and grooved portions 42 is configured to maintain wear collar 20 in the predetermined rotational orientation about the longitudinal axis of sleeve 12. In alternative embodiments, each of wear portion inner surface 22 and sleeve outer surface 32 defines any suitable shape that facilitates maintaining wear collar 20 in the predetermined rotational orientation about longitudinal axis 13 of sleeve 12.

In the exemplary embodiment, wear portion inner surface 22 also includes contour segments 38. Contour segments 38 define a first diameter 70 that is sized to enable a clearance fit of wear portion 50 over at least some contoured portions 44 of sleeve outer surface 32. In alternative embodiments, inner surface 22 does not include contoured segments 38.

The complementary fit of wear portion inner surface 22 over sleeve outer surface 32 also is configured to enable a sliding movement of wear collar 20 along sleeve 12 under a suitable applied force. For example, in some embodiments, the complementary fit of wear portion inner surface 22 over sleeve outer surface 32 is configured to enable a sliding movement of wear collar 20 along sleeve 12 in response to a manually applied force. In some such embodiments, sleeve and collar system 11 further includes a nut lock 86 configured to inhibit unintentional repositioning of wear collar 20 along sleeve 12, as will be described herein. Additionally or alternatively, the complementary fit of wear portion inner surface 22 over sleeve outer surface 32 is configured to enable a sliding movement of wear collar 20 along sleeve 12 only under a force that is higher than typical longitudinal forces encountered by wear collar 20 in operation, to avoid unintentional repositioning of wear collar 20 along sleeve 12. For another example, the suitable applied force is a force that can be applied by rotating a threaded nut 26 along helical thread 46, as will be described herein.

A radially outer surface 56 of wear portion 50 is shaped to be complementary to at least a portion of an oar-bearing surface 58 of oarlock 40. Moreover, the complementary relationship of wear portion outer surface 56 and oarlock oar-bearing surface 58 is configured to maintain oar 10 at a predetermined pitch angle 62 relative to a pin receiver 64 of oarlock 40. It should be understood that, because a blade (not shown) of oar 10 is substantially fixed relative to oar 10, pitch angle 62 determines a blade pitch angle of oar 10 in oarlock 40.

In the exemplary embodiment, wear portion outer surface 56 defines a first bearing surface 66 that is complementary to at least a portion of a pin bearing surface 90 of oarlock 40. For example, a cross-sectional shape of wear portion first bearing surface 66 is configured to be complementary to a cross-sectional shape of oarlock pin bearing surface 90. In the illustrated embodiment, oarlock pin bearing surface 90 is substantially flat, and wear portion first bearing surface 66 is substantially flat to facilitate alignment with oarlock pin bearing surface 90. In addition, a force 96 exerted during a pulling segment of a rowing stroke by oar 10, through sleeve 12 and wear portion 50, to oarlock 40 is represented schematically in FIG. 5. The complementary relationship of wear portion first bearing surface 66 and oarlock pin bearing surface 90 is configured to maintain oar 10 at the predetermined pitch angle 62 while oarlock 40 reacts force 96. Thus, in the exemplary embodiment, the complementary relationship of wear portion first bearing surface 66 and oarlock pin bearing surface 90 is configured to maintain oar 10 at predetermined pitch angle 62 relative to pin receiver 64 of oarlock 40.

Similarly in the exemplary embodiment, wear portion outer surface 56 defines a second bearing surface 92 that is complementary to at least a portion of a bottom bearing surface 94 of oarlock 40. For example, a cross-sectional shape of wear portion second bearing surface 92 is configured to be complementary to a cross-sectional shape of oarlock bottom bearing surface 94. In the illustrated embodiment, oarlock bottom bearing surface 94 is substantially flat, and wear portion second bearing surface 92 is substantially flat to facilitate alignment with oarlock bottom bearing surface 94. Thus, in the exemplary embodiment, the complementary relationship of wear portion second bearing surface 92 and oarlock bottom bearing surface 94 is configured to maintain oar 10 at predetermined pitch angle 62 relative to pin receiver 64 of oarlock 40. In alternative embodiments, second bearing surface 92 is not configured to be complementary to at least a portion of bottom bearing surface 94.

Further in the exemplary embodiment, portions 98 of wear portion outer surface 56 opposite first bearing surface 62 and second bearing surface 92 are configured to inhibit alignment with oarlock pin bearing surface 90 and bottom bearing surface 94. For example, in the illustrated embodiment, portions 98 are ridged to prevent alignment with oarlock pin bearing surface 90 and bottom bearing surface 94. Thus, a cross-sectional shape of portions 98 facilitates preventing coupling oar 10 within oarlock 40 at other than a preselected orientation about longitudinal axis 13. In alternative embodiments, portions 98 of wear portion outer surface 56 opposite first bearing surface 62 and second bearing surface 92 are not configured to inhibit alignment with oarlock pin bearing surface 90 and bottom bearing surface 94.

In alternative embodiments, each of wear portion outer surface 56 and oarlock oar-bearing surface 58 defines any suitable shape that facilitates maintaining oar 10 at predetermined pitch angle 62 relative to pin receiver 64 of oarlock 40.

Wear portion outer surface 56 facilitates maintaining substantially the same circumferential regions of wear portion 50 in contact with oarlock oar-bearing surface 58 as wear collar 20 is selectively repositioned along sleeve 12. For example, wear portion inner surface 22 and sleeve outer surface 32 cooperate to inhibit rotation, or twisting, of wear collar 20 about longitudinal axis 13 of sleeve 12, as described above, as wear collar 20 is moved from a first position to a second position along sleeve 12.

In certain embodiments, wear collar 20 is configured to be selectively re-positioned longitudinally along sleeve 12 in any environment, including on-the-water, without a use of a separate tool such as a screwdriver. In the exemplary embodiment, sleeve and collar system 11 includes a nut 26 that is configured to position wear collar 20 along sleeve 12. Nut 26 is generally ring-shaped and extends longitudinally from a first end 78 to a second end 80. A threaded portion 28 is disposed on an inner surface of nut 26. Threaded portion 28 is configured to cooperate with helical thread 46 such that nut 26 couples around sleeve 12. More specifically, nut 26 is rotatable to position nut 26 longitudinally along sleeve 12. Threaded portion 28 and helical thread 46 are configured such that rotational positioning of nut 26 along sleeve 12 produces a suitable applied force to slide wear collar 20 along sleeve 12. In alternative embodiments, sleeve and collar system 11 does not include nut 26 and helical thread 46, but is configured to be selectively repositioned longitudinally along sleeve 12 in another suitable fashion, including but not limited to by using a separate tool.

In addition, in the exemplary embodiment, wear collar 20 is coupled to nut 26, such that wear collar 20 is substantially constrained to move along sleeve 12 with nut 26. In certain embodiments, at least one coupling member 30 is used to couple wear collar 20 to nut 26. In the exemplary embodiment, coupling member 30 includes a first projection 72 configured to be captured by a radially inner edge 76 of collar portion 60 of wear collar 20, and includes a second projection 74 configured to be captured by nut first end 78. More specifically, a length 82 of coupling member 30 defined between projections 72 and 74 is selected such that first projection 72 is disposed within wear collar 20 and bears against collar portion inner edge 76, second projection 74 extends outside of, and bears against, nut first end 78, and nut second end 80 bears against collar portion 60 in substantially face-to-face contact. Thus, with particular reference to FIG. 1, if nut 26 is moved in a direction towards sleeve second end 36, nut second end 80 urges collar portion 60, and thus wear collar 20, towards sleeve second end 36. If nut 26 is moved in a direction towards sleeve first end 34, nut first end 78 urges second projection 74 towards sleeve first end 34, causing first projection 72 to urge collar portion 60, and thus wear collar 20, towards sleeve first end 34.

Further in the exemplary embodiment, a width 84 of coupling member 30 is selected such that coupling member 30 is configured to be slidably received within one of plurality of contoured portions 44 of sleeve outer surface 32. Contoured portion 44 facilitates a longitudinal sliding movement of coupling member 30 when nut 26 is rotated to reposition wear collar 20.

In alternative embodiments, the at least one coupling member 30 is configured in any suitable fashion that substantially constrains wear collar 20 to move along sleeve 12 with nut 26. In other alternative embodiments, at least one of wear collar 20 and nut 26 includes a suitable integral structure that substantially constrains wear collar 20 to move along sleeve 12 with nut 26. In still other alternative embodiments, wear collar 20 is not substantially constrained to move along sleeve 12 with nut 26, but is manually repositionable adjacent nut 26 after nut 26 is moved.

In some embodiments, sleeve and collar system 11 also includes nut lock 86 configured to inhibit unintentional rotation of nut 26 along helical thread 46 and, thus, inhibit unintentional repositioning of wear collar 20 along sleeve 12. More specifically, nut lock 86 is configured to maintain a predetermined rotational orientation about longitudinal axis 13 of sleeve 12, and to releasably engage nut 26 such that nut 26 also is maintained in a predetermined rotational orientation about longitudinal axis 13 when engaged.

For example, in the exemplary embodiment, nut lock 86 defines a generally annular shape, and a radially inner surface of nut lock 86 is shaped to be complementary to at least a portion of outer surface 32 of sleeve 12. Moreover, the complementary relationship of nut lock 86 and sleeve outer surface 32 is configured to maintain nut lock 86 in a predetermined rotational orientation about longitudinal axis 13 of sleeve 12 when nut lock 86 is positioned along sleeve 12. Further in the exemplary embodiment, nut lock 86 defines a groove 88 configured to engage any of a plurality of ribs 29 defined on nut 26. Thus, when groove 88 engages one of ribs 29, nut lock 86 inhibits rotation of nut 26 with respect to sleeve 12 about longitudinal axis 13. In alternative embodiments, nut lock 86 includes any suitable structure, and sleeve 12 and/or nut 26 includes any suitable complementary structure, that enables nut lock 86 to inhibit unintentional rotation of nut 26 along helical thread 46.

In the exemplary embodiment, nut lock 86 is configured for sliding movement along sleeve 12 under a suitable applied force. For example, in some embodiments, the complementary fit of nut lock 86 over sleeve outer surface 32 is configured to enable a sliding movement of nut lock 86 along sleeve 12 in response to a manually applied force. Thus, nut lock 86 is slidable toward nut 26 for engagement of groove 88 with one of ribs 29, and is slidable away from nut 26 for releasing the engagement of groove 88 with rib 29. In alternative embodiments, nut lock 86 includes any suitable structure, and nut 26 includes any suitable complementary structure, that enables nut lock 86 to releasably engage nut 26.

In alternative embodiments, sleeve and collar system 11 does not include nut lock 86. For example, but not by way of limitation, the complementary fit of wear portion inner surface 22 over sleeve outer surface 32 is configured to enable a sliding movement of wear collar 20 along sleeve 12 only under a force that is higher than a suitable threshold force, to inhibit repositioning of wear collar 20 along sleeve 12 due to unintentional rotation of nut 26.

With particular reference to FIG. 3, wear portion 50 of wear collar 20 is sized such that, when oar 10 is coupled to sleeve and collar system 11 and inserted in oarlock 40 such that collar portion 60 bears against oarlock 40, wear collar 20, rather than sleeve 12, bears against oarlock oar-bearing surface 58. Thus, as oar 10 is moved through a rowing stroke, wear collar 20 bears substantially all of the direct contact from oarlock 40 during the rowing stroke. It should be understood that the term "substantially all" envisions that occasional and/or limited direct contact between oarlock 40 and sleeve 12 can occur. For example, but not by way of limitation, in some circumstances, sleeve 12 may contact oarlock 40 during a compression portion, but not a rotation portion, of the rowing stroke.

Moreover, when wear collar 20 is selectively repositioned along sleeve 12 and oar 10 again is positioned such that collar portion 60 bears against oarlock 40, substantially the same portions of wear collar 20 again bear against oarlock oar-bearing surface 58. It should be noted that, as wear collar 20 eventually degrades after repeated use, a new wear collar 20 can be coupled to the existing sleeve 12, which suffers comparatively little wear.

Exemplary embodiments of a sleeve and collar system for an oar are described above in detail. The embodiments provide a wear collar configured to bear substantially all of the direct contact from an oarlock during a rowing stroke, and a sleeve with an outer surface that is less susceptible to twisting and/or bulging than a sleeve formed to bear substantial direct contact with the oarlock. The embodiments also provide a complementary relationship of a wear collar inner surface and a sleeve outer surface that maintains the wear collar in a predetermined rotational orientation about a longitudinal axis of the sleeve. Additionally, the embodiments provide a wear collar outer surface that cooperates with an oar-bearing surface of the oarlock to facilitate maintaining a constant blade pitch angle. Certain embodiments further provide a sleeve with a discontinuous helical thread disposed at least partially co-extensively along the complementary portion of the sleeve outer surface, and a threaded nut that cooperates with the discontinuous helical thread to position the wear collar at any selected location along the sleeve. Thus, certain embodiments provide a sleeve and wear collar system for an oar that is capable of being adjusted anywhere, including on-the-water, without the use of a separate tool, such as a screwdriver, because the adjustment mechanism is self-contained.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other assemblies and methods.

While the disclosure has been described in terms of various specific embodiments, those skilled in the art will recognize that the disclosure can be practiced with modification within the spirit and scope of the claims. Although specific features of various embodiments of the disclosure may be shown in some drawings and not in others, this is for convenience only. Moreover, references to "one embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

What is claimed is:

1. A sleeve and collar system for an oar, said system comprising:

a sleeve configured to couple to a shaft portion of the oar, said sleeve comprising an outer surface; and a wear collar configured to couple around said sleeve at each of a plurality of longitudinal positions along said sleeve, said wear collar configured to bear substantially all direct contact from an oarlock during a rowing stroke of the oar, a radially inner surface of said wear collar is shaped to be complementary to at least a portion of said sleeve outer surface, such that said wear collar inner surface and said sleeve outer surface cooperate to maintain said wear collar in a predetermined orientation about a longitudinal axis of said sleeve at each of said plurality of longitudinal positions, wherein said wear collar inner surface is configured to engage said sleeve outer surface in a complementary fit that enables a sliding movement of said wear collar longitudinally along said sleeve.

2. The system of claim 1, wherein said sleeve outer surface comprises a plurality of alignment surfaces, each of said alignment surfaces extends longitudinally along said sleeve.

3. The system of claim 2, wherein said wear collar inner surface defines a plurality of grooved portions that are complementary to said plurality of alignment surfaces to facilitate maintaining said wear collar in the predetermined rotational orientation about said longitudinal axis.

4. A sleeve and collar system for an oar, said system comprising:

a sleeve configured to couple to a shaft portion of the oar, said sleeve comprising an outer surface; and a wear collar configured to couple around said sleeve at each of a plurality of longitudinal positions along said sleeve, said wear collar configured to bear substantially all direct contact from an oarlock during a rowing stroke of the oar, a radially inner surface of said wear collar is shaped to be complementary to at least a portion of said sleeve outer surface, such that said wear collar inner surface and said sleeve outer surface cooperate to maintain said wear collar in a predetermined orientation about a longitudinal axis of said sleeve at each of said plurality of longitudinal positions, wherein said sleeve outer surface comprises a plurality of alignment surfaces, each of said alignment surfaces extends longitudinally along said sleeve, and wherein each said alignment surface comprises a plurality of grooves defined therein, said grooves cooperate to define a helical thread.

5. The system of claim 4, further comprising a nut, wherein a threaded portion is disposed on an inner surface of said nut, said threaded portion configured to cooperate with said helical thread such that said nut is rotatable to position said nut longitudinally along said sleeve.

6. The system of claim 5, wherein said wear collar is configured to couple to said nut, such that said wear collar is substantially constrained to move longitudinally along said sleeve with said nut.

7. An oar comprising:

a shaft portion;

a sleeve coupled to said shaft portion, said sleeve comprising an outer surface; and a wear collar configured to couple around said sleeve at each of a plurality of longitudinal positions along said sleeve, said wear collar configured to bear substantially all direct contact from an oarlock during a rowing stroke of said oar, a radially inner surface of said wear collar is shaped to be complementary to at least a portion of said sleeve outer surface, such that said wear collar inner surface and said sleeve outer surface cooperate to maintain said wear collar in a predetermined orientation about a longitudinal axis of said sleeve at each of said plurality of longitudinal positions, wherein said wear collar inner surface is configured to engage said sleeve outer surface in a complementary fit that enables a sliding movement of said wear collar longitudinally along said sleeve.

8. The system of claim 7, wherein said sleeve outer surface comprises a plurality of alignment surfaces, each of said alignment surfaces extends longitudinally along said sleeve.

9. The system of claim 8, wherein said wear collar inner surface defines a plurality of grooved portions that are complementary to said plurality of alignment surfaces to facilitate maintaining said wear collar in the predetermined rotational orientation about said longitudinal axis.

10. The system of claim 8, wherein each said alignment surface comprises a plurality of grooves defined therein, said grooves cooperate to define a helical thread.

11. The system of claim 10, further comprising a nut, wherein a threaded portion is disposed on an inner surface of said nut, said threaded portion configured to cooperate with said helical thread such that said nut is rotatable to position said nut longitudinally along said sleeve.

12. The system of claim 11, wherein said wear collar is configured to couple to said nut, such that said wear collar is substantially constrained to move longitudinally along said sleeve with said nut.

13. The system of claim 2, wherein each said alignment surface comprises a plurality of grooves defined therein, said grooves cooperate to define a helical thread.

14. The system of claim 13, further comprising a nut, wherein a threaded portion is disposed on an inner surface of said nut, said threaded portion configured to cooperate with said helical thread such that said nut is rotatable to position said nut longitudinally along said sleeve.

15. The system of claim 14, wherein said wear collar is configured to couple to said nut, such that said wear collar is substantially constrained to move longitudinally along said sleeve with said nut.

16. The system of claim 4, wherein said wear collar inner surface is configured to engage said sleeve outer surface in a complementary fit that enables a sliding movement of said wear collar longitudinally along said sleeve.

17. The system of claim 4, wherein said wear collar inner surface defines a plurality of grooved portions that are complementary to said plurality of alignment surfaces to facilitate maintaining said wear collar in the predetermined rotational orientation about said longitudinal axis.

* * * * *